US007370502B2

(12) United States Patent
Widen

(10) Patent No.: US 7,370,502 B2
(45) Date of Patent: May 13, 2008

(54) HIGH SECURITY LOCK AND KEY BLADE COMBINATION

(75) Inventor: Bo Widen, Torshälla (SE)

(73) Assignee: Winloc AG, Zug (CH)

( * ) Notice: Subject to any disclaimer, the term of this patent is extended or adjusted under 35 U.S.C. 154(b) by 0 days.

(21) Appl. No.: 10/500,729

(22) PCT Filed: Jan. 17, 2003

(86) PCT No.: PCT/SE03/00074

§ 371 (c)(1),
(2), (4) Date: Jul. 20, 2004

(87) PCT Pub. No.: WO03/062570

PCT Pub. Date: Jul. 31, 2003

(65) Prior Publication Data

US 2005/0172688 A1 Aug. 11, 2005

(30) Foreign Application Priority Data

Jan. 23, 2002 (SE) ..... 0200182

(51) Int. Cl.
*E05B 27/04* (2006.01)

(52) U.S. Cl. ..... 70/493; 70/409; 70/495

(58) Field of Classification Search ..... 70/409, 70/492–495, 378, 392, DIG. 22, DIG. 25
See application file for complete search history.

(56) References Cited

U.S. PATENT DOCUMENTS

| | | | | | |
|---|---|---|---|---|---|
| 564,803 | A * | 7/1896 | Stadtmuller | ..... | 70/340 |
| 1,244,450 | A * | 10/1917 | Christoph | ..... | 70/492 |
| 1,328,074 | A * | 1/1920 | Bennett | ..... | 70/492 |
| 2,023,207 | A * | 12/1935 | Olson | ..... | 70/406 |
| 2,079,628 | A * | 5/1937 | Olson | ..... | 70/492 |
| 2,155,734 | A | 4/1939 | Olson | | |
| 2,375,682 | A * | 5/1945 | Olson | ..... | 70/492 |
| 3,264,852 | A * | 8/1966 | Gysin | ..... | 70/358 |
| 3,969,915 | A * | 7/1976 | Droske | ..... | 70/492 |
| 4,478,061 | A | 10/1984 | Preddey | | |
| 4,756,177 | A | 7/1988 | Widen | | |
| 4,760,722 | A | 8/1988 | Fann et al. | | |
| 4,815,307 | A | 3/1989 | Widen | | |
| 5,067,335 | A | 11/1991 | Widen | | |
| 5,582,050 | A * | 12/1996 | Haggstrom | ..... | 70/495 |
| 5,640,865 | A | 6/1997 | Widen | | |
| 5,809,816 | A | 9/1998 | Widen | | |
| 5,956,986 | A * | 9/1999 | Vonlanthen | ..... | 70/492 |
| 6,308,543 | B1 * | 10/2001 | Yoshizawa | ..... | 70/492 |
| 6,758,074 | B1 * | 7/2004 | Prunbauer | ..... | 70/366 |

FOREIGN PATENT DOCUMENTS

| | | | | | |
|---|---|---|---|---|---|
| DE | 2204630 | * | 8/1972 | ..... | 70/492 |
| EP | 0103532 | A2 | 3/1984 | | |
| GB | 1114111 | A2 | 5/1968 | | |
| TW | 425451 | | 3/2001 | | |

* cited by examiner

*Primary Examiner*—Lloyd A. Gall
(74) *Attorney, Agent, or Firm*—Birch, Stewart, Kolasch & Birch, LLP

(57) ABSTRACT

A high security cylinder lock (1) and key (2) combination comprising a cylindrical shell (140), a key plug (130) which is rotatably mounted in the shell (140), a longitudinal key slot (100) in the key plug, and at least one locking tumbler assembly cooperating with a key being inserted into the lock. The locking tumbler assembly comprises a pair of independently movable tumbler segments (113, 114) which are positionable in different elevational positions in a common cavity.

10 Claims, 6 Drawing Sheets

Fig. 1
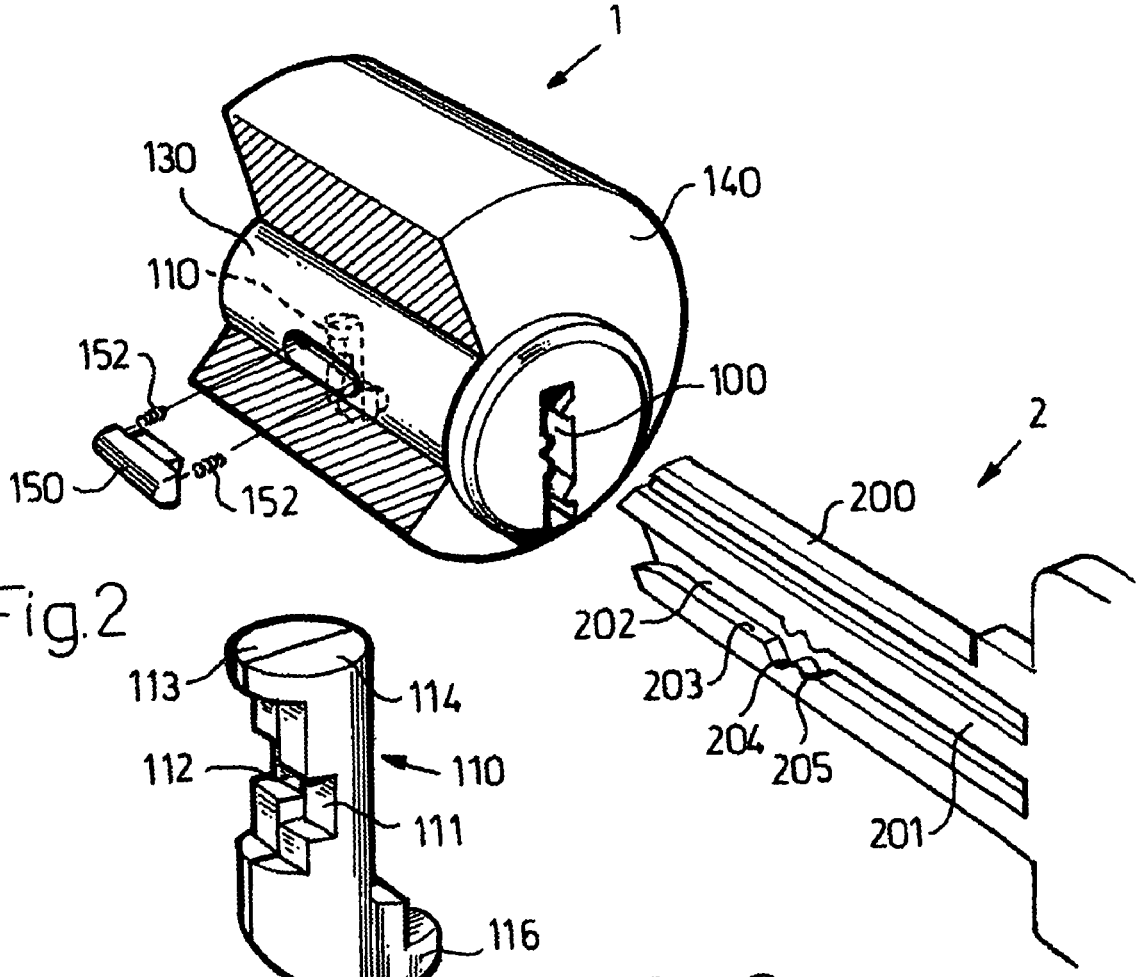
Fig. 2
Fig. 3
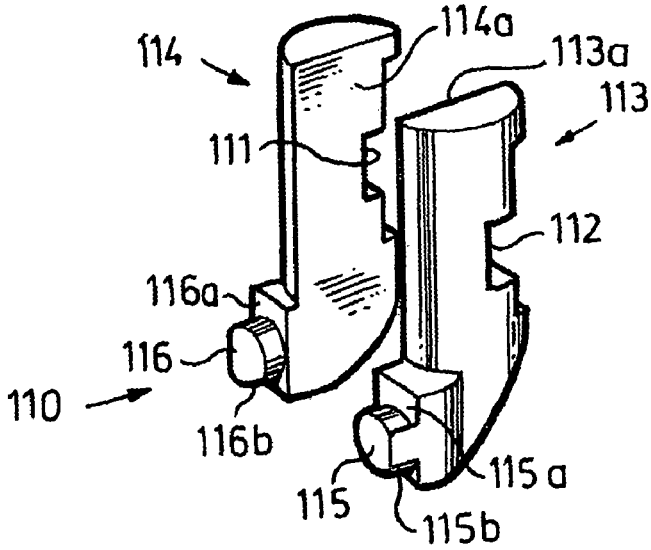

HIGH SECURITY LOCK AND KEY BLADE COMBINATION

FIELD OF THE INVENTION

The present invention concerns a cylinder lock and key combination comprising a cylinder shell, a key plug which is rotatably mounted in said shell, a longitudinal key slot extending along said key plug in parallel to the rotational axis for receiving a key blade having, at a side surface thereof, a longitudinally extending coded surface, at least one locking tumbler assembly having a body segment with a contact portion reaching into said key slot so as to engage with said coded surface of a properly shaped key blade upon insertion thereof into said key slot, and at least one cavity located at a transversal side of said key slot in said key plug, said cavity accommodating an associated one of said at least one tumbler assembly and guiding the latter for elevational movement therein.

BACKGROUND OF THE INVENTION

Such a lock is previously known from the patent specifications U.S. Pat. Nos. 4,756,177, 4,815,307, 5,640,865 and 5,067,335 (all in the name of Widén). In the locks disclosed in these references, each tumbler assembly has a finger portion projecting outwardly therefrom, either in different angular directions or at different positions, such that the longitudinal distribution of the outer ends (contact portions) of the finger portions generally differs from the normally regular distribution of the locking tumblers themselves in the longitudinal direction, i.e. in parallel with the key slot.

In this way, the number of code combinations can be made very high. Each tumbler assembly is elevationally movable in the associated cavity and, in addition, the specific position of the contact portion in said longitudinal direction along the key slot provides further code possibilities.

These known locks provide a great number of code combinations, and also a high security against picking.

SUMMARY OF THE INVENTION

The object of the present invention is to provide a high security lock and key combination of the aforementioned kind with a locking mechanism having at least the same high number of code combinations as the known locks and providing an even higher security against picking.

According to the present invention, this object is achieved for a lock of the aforementioned kind in that at least one locking tumbler assembly of the lock comprises a pair of adjacent tumbler body segments accommodated in the same cavity, each tumbler body segment having a contact portion (not necessarily in the form of a finger) reaching into the key slot. The adjacent tumbler body segments in said pair are guided in said cavity for elevational movement independently of each other. The adjacent body segments in the pair are individually displaced into respective elevational positions while being engaged, at said contact portions, by said coded surface upon insertion of said key blade into said key slot. Also, the associated contact portions in the pair are axially separated in the longitudinal direction of the key plug such that these contact portions will be positioned at elevationally specific and generally different levels when being engaged by the coded surface upon insertion of key blade into the key slot.

The U.S. Pat. No. 2,155,734 discloses a similar lock and key system where each tumbler assembly comprises a pair of adjacent tumbler segments. However, these segments in a pair are coupled to each other by a spring acting to separate the two segments in opposite direction from each other. The two segments have a limited mobility. Also, the associated contact portions in the pair are located in close vicinity to each other. Therefore, in order to cooperate properly with a coded surface on a key blade, they must be positioned at approximately the same level.

In contrast, in the lock according to the present invention, the two body segments in a pair can be located in many different relative positions. For each elevational position of one of the body segments, the other body segment can be positioned in various positions. Accordingly, the total number of code combinations is very high. Moreover, since the contact portions of a pair are located relatively close to each other, although they are axially separated from each other, it is very difficult to manipulate one contact portion without also displacing the other one. Therefore, the lock has a very high level of security against picking.

Many different embodiments are possible within the general inventive concept, as set forth in the dependent claims.

The invention also concerns a key blade (and a corresponding key blank) having, at a side surface thereof, a longitudinally extending coded surface with at least one pair of neighbouring code surface portions (or, in a key blank, at least one material region for cutting out a pair of neighbouring code surface portions) for co-operation with the respective contact portions of a pair of adjacent tumbler body segments of a lock as defined above.

The invention will be explained further below with reference to the appended drawings illustrating some preferred embodiments of the invention.

SHORT DESCRIPTION OF THE DRAWINGS

FIG. 1 shows, in a perspective view, a cylinder lock and key combination according to the invention, in a first, rather simple embodiment having only one tumbler assembly, a part of the cylinder shell being cut away for clarity;

FIG. 2 shows, in a larger scale, the tumbler assembly included in the lock of FIG. 1;

FIG. 3 shows two separate portions of the tumbler assembly of FIG. 2;

Figure 6A:
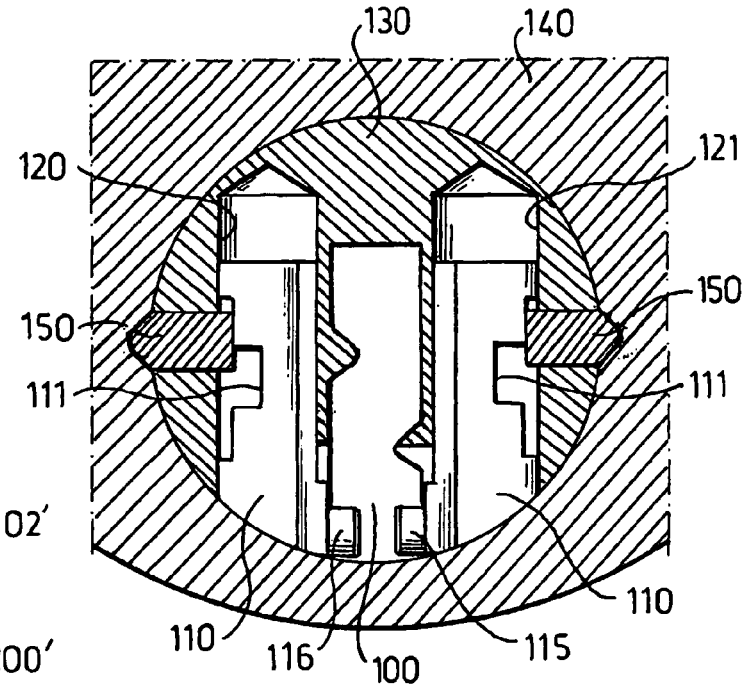
Figure 6B:
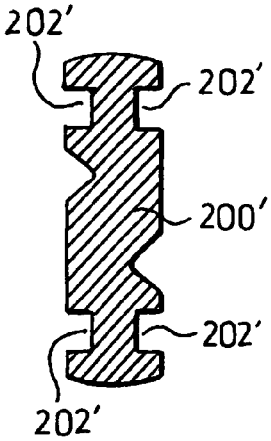

FIG. 6*a* shows a cross-section through a second embodiment of the lock with two tumbler assemblies, one on each side of the key slot;

FIG. 6*b* shows a cross-section through a key blade associated with the lock of FIG. 6*a;*

Figure 7:
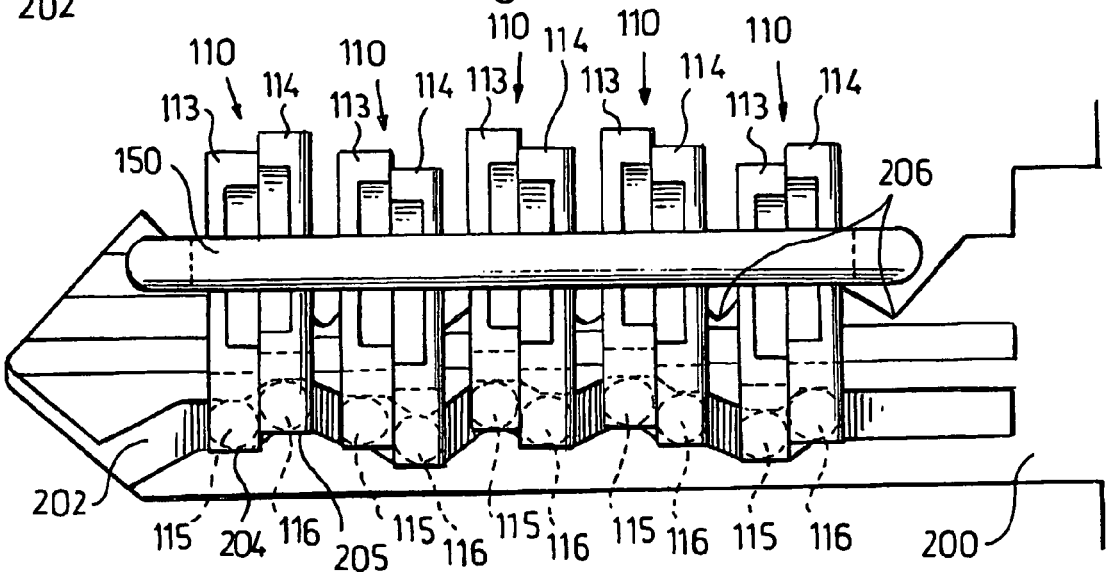
Figure 8:
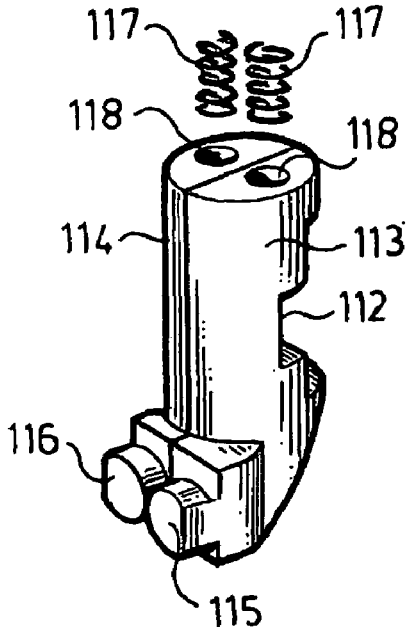
Figure 9:
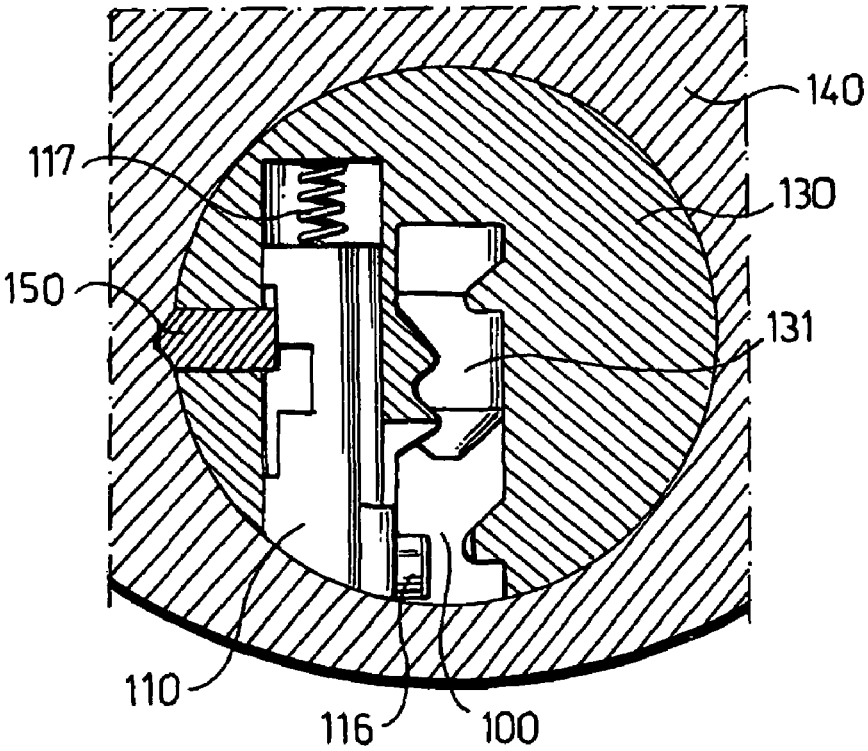
Figure 10:
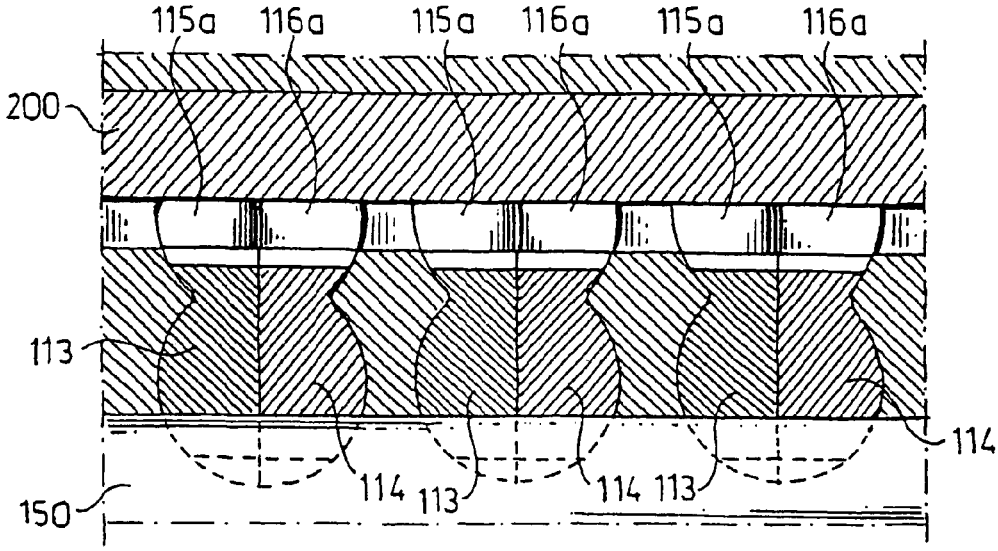
Figure 11:
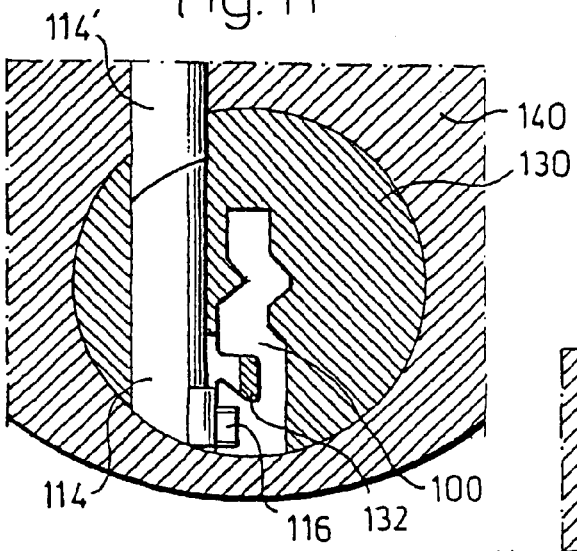
Figure 12:
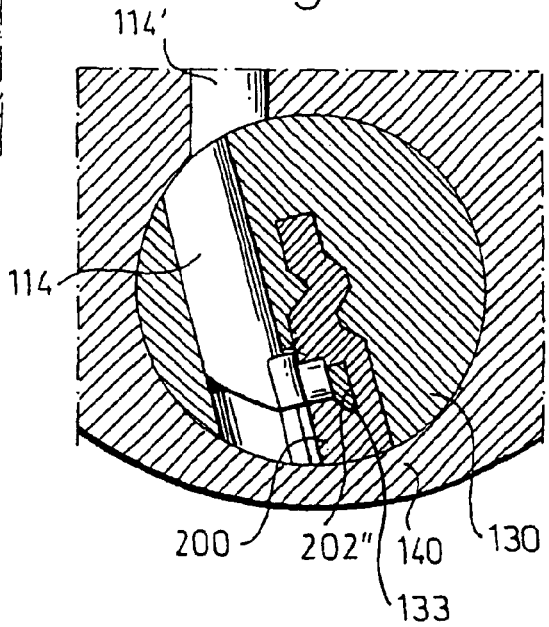
Figure 13:
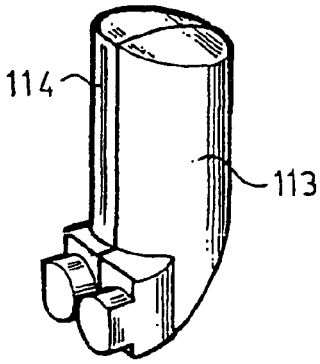
Figure 14:
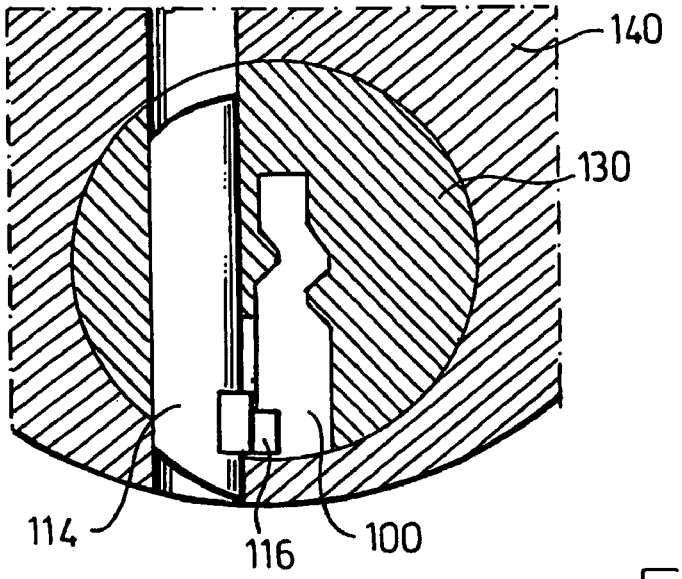
Figure 15:
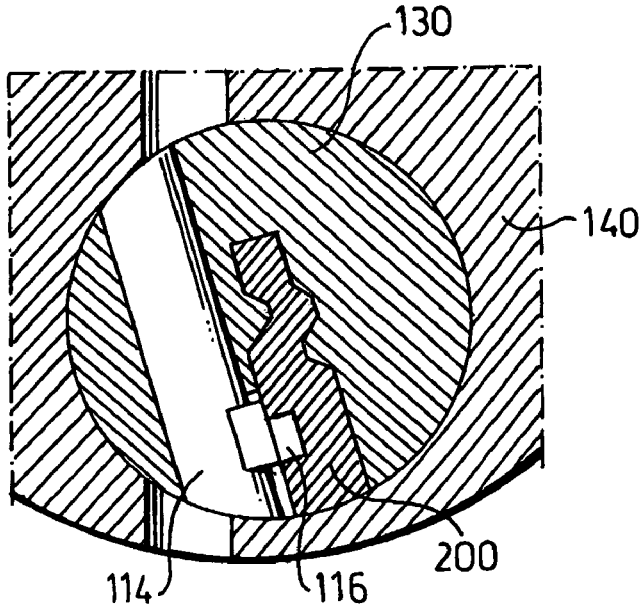
Figure 16:
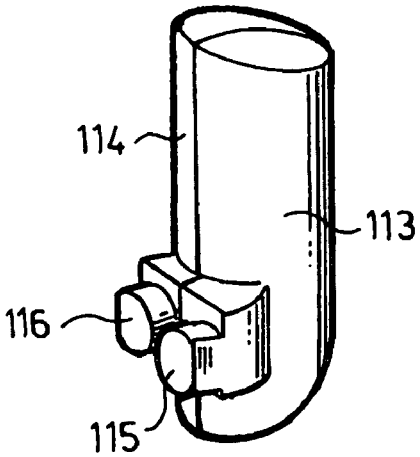

FIG. 7 shows a schematical view of a third embodiment of a lock and key blade with five tumbler assemblies in a row (the rest of the lock is not shown);

FIG. 8 shows a tumbler assembly of a modified embodiment (with spring-loaded tumbler segments);

FIG. 9 shows a cross-section through a lock with a tumbler assembly as shown in FIG. 8;

FIG. 10 shows a longitudinal section through the lock and key blade of FIG. 7;

FIG. 11 shows a cross-section of a fourth embodiment of the lock according to the invention;

FIG. 12 shows a corresponding cross-section as in FIG. 11 with the key plug rotated by an inserted key blade;

FIG. 13 shows a tumbler assembly included in the lock of FIG. 11 separately;

FIG. 14 shows a cross-section of a fifth embodiment of the lock according to the invention;

FIG. 15 shows a corresponding cross-section as in FIG. 14, with the key plug of the lock being rotated by an inserted key blade; and FIG. 16 shows separately a tumbler assembly included in the lock of FIGS. 14 and 15.

DETAILED DESCRIPTION OF PREFERRED EMBODIMENTS

The lock and key combination shown in FIG. 1 includes a cylinder lock 1 and a key 2 with a key blade 200 which is insertable into a key slot 100 of the lock. The profile of the key blade 200 is shown in cross-section in FIG. 5 and corresponds generally to the profile of the key slot 100.

The cylinder lock is of a similar kind as disclosed in the above mentioned U.S. patent specifications, although it is a simplified version with no centrally located tumblers and only one tumbler assembly 110 (see also FIGS. 2 and 3), indicated by dotted lines in FIG. 1. The tumbler assembly 110 is located at a transversal side of the key slot 100, as shown clearly in FIGS. 4 and 5. The tumbler assembly 110 is guided in a cavity 120 located in a cylindrical key plug 130, which is rotatable in a corresponding cylindrical recess 141 in a cylindrical shell 140.

Figure 4:
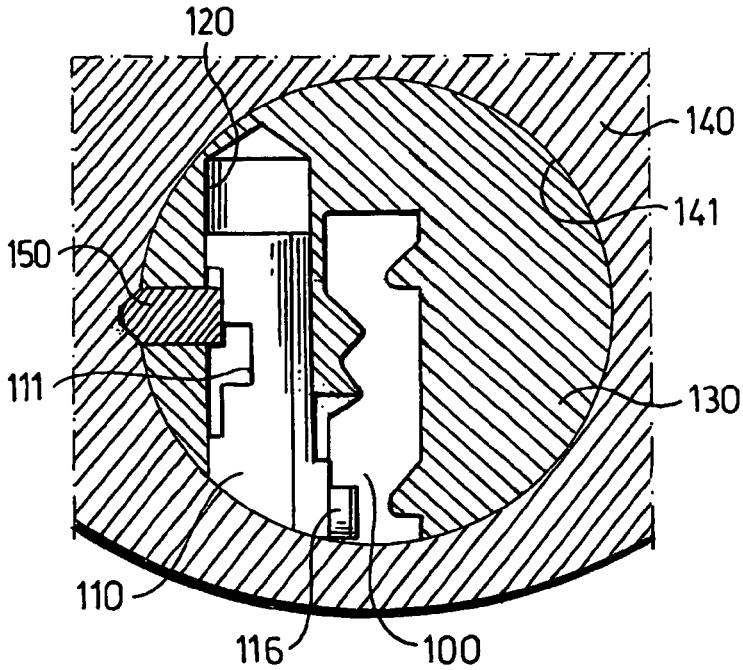
FIG. 4 shows a cross-section of the lock of FIG. 1.

The locking function i.e. the locking of the key plug 130 against rotation within the cylindrical shell 140 is effected by a fence member or side bar 150. As illustrated in FIG. 1, the side bar 150 is spring-loaded radially outwardly so as to fit into a longitudinally extending seating recess 151 (FIG. 5) in the cylindrical shell 140. The side bar 150 is kept in locking position (FIG. 4) unless the tumbler assembly 110 is positioned in such a way, upon insertion of a properly coded key blade into the key plug, that the side bar 150 can fit into mutually aligned recesses 111, 112. In the position illustrated in FIG. 2, however, these recesses 111, 112 are not aligned and the side bar 150 will then be unable to move from its blocking position (FIG. 4).

Figure 5:
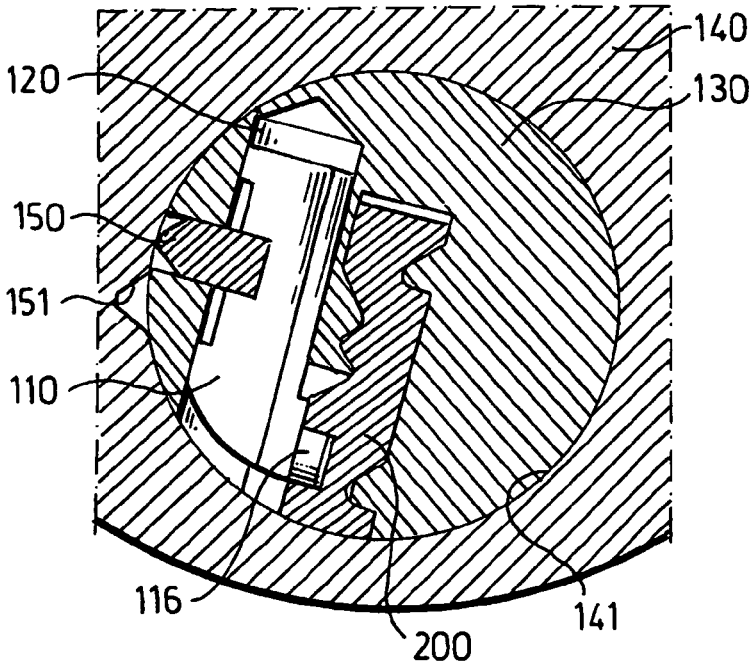
FIG. 5 shows a corresponding cross-section as in FIG. 4, with the key plug of the lock rotated by an inserted key.

According to the present invention, the tumbler assembly 110 comprises a pair of adjacent tumbler body segments 113, 114 (see FIG. 3), which are guided in the same cavity but are elevationally movable independently of each other therein. Because of the separate mobility of these two body segments 113, 114, they can be individually displaced so that the recesses 111, 112 become mutually aligned. Now, the side bar 150 can be brought into the aligned recesses 111, 112, as illustrated in FIG. 5. Thus,upon alignment of the recesses 111,112, the side bar 150 can be moved into this releasing position by applying a rotating force onto the key plug 130. Then, the side bar 150 will be forced to move radially inwards against the action of the springs 152.

The two tumbler body segments 113,114 preferably have supplementary cross-sections so as to occupy a respective portion of the cavity 120 and be guided within this cavity in a well-defined manner without tilting or rotating relative to the central axis of the cavity. In this embodiment, the cavity 120 is circular-cylindrical, and the tumbler body segments 113,114 have part-cylindrical surface portions being guided by the cylindrical wall of the cavity 120. The two tumbler body segments 113,114 in the pair also have mutually contacting surface portions 113*a*, 114*a*, which permit a relative sliding movement therebetween. In the illustrated embodiment, these mutually contacting surface portions are planar, but they could have any other geometrical form permitting a sliding contact. Also, the cavity may have some other cross-sectional configuration, e.g. rectangular, and the tumbler body segments may be adapted to such a configuration so as to ensure a good guidance within the cavity.

The movement of the separate body segments 113, 114 of the locking tumbler assembly 110 is accomplished by means of the key blade 200 having, at a substantially planar side surface 201 thereof, a longitudinally extending coded surface 203 in a groove 202. The groove 202 has a bottom wall and upper and lower sidewalls. The lower sidewall 203 forms a wave-like coded surface, which in this embodiment includes two neighbouring code surface portions 204, 205. These code surface portions 204, 205 are designed to receive a respective contact portion, in the form of an outwardly projecting finger 115, 116, on each tumbler body segment 113,114. In the illustrated embodiment, each contact portion or finger has a relatively wide base portion 115*a* and 116*a*, respectively, and a relatively narrow, substantially cylindrical free end portion 115*b* and 116*d*, respectively. When the key blade 200 is inserted into the key slot 100 of the lock 1, the fingers 115, 116 will be positively guided in the groove 202. In the fully inserted position, the fingers 115, 116 will be located in the neighbouring code surface portions 204, 205, so that the recesses 111, 112 are aligned, the side bar 150 may be displaced into these recesses upon applying a rotary torque onto the key plug 130, whereupon the latter can be rotated by turning the key 2, as shown in FIG. 5.

In the illustrated embodiment, the longitudinal groove 202 has substantially parallel upper and lower sidewalls so as to positively guide the respective fingers 115,116. Alternatively, the groove 202 may be much wider than the diameter of the end portion 115*b*, 116*b* of the respective finger. In the latter case, the fingers are preferably spring-loaded (see FIGS. 8 and 9) so as to engage slidingly with the lower coded sidewall 203 and the coded surface portions 204, 205.

In the second embodiment of the lock and key combination, as illustrated in FIG. 6*a*, the key blade 200' (FIG. 6*b*) is provided with grooves 202' on each lateral side. These grooves may be undercut, if so desired (see also FIGS. 11 and 12).

In the lock of FIG. 6*a*, there is a cavity 120,121 on each transversal side of the central key slot 100 in the key plug 130. In each cavity 120, 121, there is a tumbler assembly 110 comprising two independently movable body segments 113, 114 of the kind shown in FIGS. 2 and 3. Each tumbler assembly 110 co-operates with a side bar 150 in the manner described above.

In the embodiment of FIG. 6*a*, the key blade 200 (FIG. 6*b*) is symmetrical, so that it can be turned upside down and still work properly in co-operation with the key slot 100 and the fingers 115, 116 of the respective tumbler assemblies 110.

As illustrated in FIG. 7, the lock may have a longitudinal row of tumbler assemblies 110 (five in a row), each tumbler assembly having a pair of independently movable body segments 113, 114 with associated contact portions or fingers 115, 116. When the key blade 200 is inserted into the lock, all the fingers 115, 116 will be positively guided by the longitudinally extending coded groove 202, which in this case has ten different code surface portions each being located at a specific code level. These code surface portions 204, 205 are grouped into five pairs each comprising two neighbouring code surface portions 204, 205. For a specific level of a code surface portion 204, the neighbouring code surface portion 205 may be located in at least two or possibly three, four, five or even a higher number of different levels. Accordingly, the total number of code combinations will be very great. Of course, the total number of code combinations may be substantially increased by also providing an ordinary code pattern at the longitudinal top edge surface of the key blade 200, as indicated by the numeral 206 in FIG. 7. Even in this third embodiment with a longitudinal row of tumbler assemblies 110, there may be such a row on each transversal side of the key slot of the lock (similar to the embodiment illustrated in FIG. 6*a*).

As indicated above, each body segment 113, 114, may alternatively be spring-loaded, as indicated in FIGS. 8 and 9, by means of helical springs 117 seated in holes 118 at the top end of each body segment 113, 114. In FIG. 9, there is also shown, in the key slot 100, a central tumbler 131 (one in a longitudinal row of such tumblers) co-operating with the coded cuts or dimples 206 in the edge portion of the key blade 200.

In the partial longitudinal section shown in FIG. 10, the respective body segments 113, 114 and the associated wider finger base portions 115*a*, 116*a* are visible as is the key blade 200. In order to lock the key plug 130 against rotation within the cylinder shell 140, it is possible (see FIGS. 11 and 12) to use top tumblers or pins 113' (not shown) and 114', which stay in contact with and follow the associated body portions 113, 114. In a specific elevational position, as illustrated in FIG. 12, the body segment 114 and the associated top pin 114' have their mutually engaging surfaces located in the shear line, whereby the key plug 130 can be rotated in the shell 140.

In this fourth embodiment, the key blade 200 has an undercut groove 202" co-operating with a corresponding profile tongue 132 having a downwardly projecting portion 133 fitting into the undercut portion of the groove 202" of the key blade.

In all embodiments and modifications described above, there is at least one tumbler assembly 110 comprising a pair of body segments 113, 114 being elevationally movable independently of each other while engaging (with its associated contact portion or finger 115, 116) the coded groove 202 of the key blade 202, when the latter is inserted into the lock. A very great number of code combinations is obtainable, and the lock has a very high security against picking, as explained above.

Further modifications are possible within the scope of the claims. The tumbler body portions 113, 114 are illustrated to be substantially half-cylindrical with two mutually engaging, substantially flat surfaces 113*a*, 114*a* (FIG. 3). Of course, other geometrical shapes are also possible as long as the two body portions are properly guided within the associated cavity 120 and are capable of moving independently of each other while being engaged, by way of the contact portions or fingers, with the coded surface at the key blade.

The key blade can be furnished with coded bittings and/or dimples on other surfaces corresponding to tumber mechanisms of various kinds, such as coded dimples on the respective edge portions of the key blade of FIG. 6*b* cooperating with centrally located pin tumblers (not shown) in FIG. 6*a*.

Instead of a groove 202, the coded surface may be formed on a step surface or shelf forming a transition between a massive base portion of the key blade and an upper, narrower portion thereof.

The outwardly projecting finger 115,116 does not have to be located at an end portion of the associated tumbler but could be located somewhere between these end portions. Such an embodiment is shown in FIGS. 14, 15 and 16. Here, the tumbler segments 114 have a length (or height) corresponding to the key plug 130. The cavity 120 adjoins corresponding cylindrical cavities in the shell 140. The tumbler segment 114 locks the key plug against rotation, unless it is located exactly in the position shown in FIG. 15. Then, the key plug can be rotated by turning the key blade 200.

Furthermore, the contact portion of the tumbler body segment 113,114 does not have to be formed as a finger but may have any other geometrical shape as long as the contact portion reaches into the key slot so as to engage with the coded surface of the key blade. Also, the contact portion does not have to project outwardly sideways. It may even form a part of the (cylindrical) tumbler body segment itself.

As indicated above, the cavity may have a different cross-sectional shape, such as elliptic, rectangular or polygonal, and the two tumbler body segments should then be adapted to such a configuration.

The cavities (and the direction of elevational movement of the tumbler portions) may have any suitable angle (0-90 degrees) to the central plane of the key slot.

Moreover, the locking mechanism as defined in the claims may be combined with other locking mechanisms in the same lock. One locking mechanism, according to the invention, may be provided on one transversal side of the key slot, whereas another mechanism, possibly also in accordance with the present invention, may be arranged on the other transversal side of the key slot. As indicated above, conventional locking tumbler pins may also be located centrally above the key slot. While the most practical embodiment of the invention (from a manufacturing and tolerance point of view as well as operational reliability) it is preferred that each locking tumbler assembly consists of a pair of tumbler segments, it is conceivable to add an intermediate or third tumbler segment therebetween.

The invention claimed is:

1. A cylinder lock (1) and key (2) combination, said key (2) comprising a key blade (200) having, at a side surface (201) thereof, a longitudinally extending coded side surface (203) with longitudinally spaced code surface portions each representing an element of a key code, and said cylinder lock (1) comprising a cylinder shell (140), a key plug (130) which is rotatably mounted in said shell, a longitudinal key slot (100) extending along said key plug in parallel to the rotational axis thereof for receiving said key blade (200), at least two side tumblers (113, 114) in said key plug for locking said key plug against rotation relative to said cylinder shell, unless a correctly coded key is inserted into said key slot, each side tumbler being provided with a contact finger (115, 116) reaching sideways into said key slot so as to engage with said coded surface (203) of a properly shaped key blade being inserted into said key slot, and at least one side cavity (120) located at a transversal side of said key slot (100) in said key plug (130), said at least one side cavity accommodating and guiding said side tumblers for elevational movement therein, wherein:

said at least two side tumblers are distributed pair-wise, with two adjacent side tumblers (113, 114) located in a respective side cavity on the same side of said key slot, said adjacent side tumblers (113, 114) in each pair being linearly guided but independently movable in the respective side cavity so as to be individually displaced linearly into respective elevational positions, and said contact fingers (115, 116) on the adjacent side tumblers in each pair having contact portions facing in the same direction and being axially separated in the longitudinal direction of the key plug such that these contact fingers are located at a longitudinal distance from each other on the same side of said key slot and will be positioned at elevationally specific and generally different code levels when being engaged by two neighbouring, longitudinally spaced code surface portions (204, 205) of said coded surface (203) upon insertion of said key blade (200) into said key slot (100), whereby said at least two side tumblers (113, 114) are displaceable, upon insertion of said key blade into said key slot, into individually specific elevational code positions, and each set of such elevational code positions representing a different key code with an increased number of code elements, a pair of side tumblers corresponding to two code elements.

2. A cylinder lock and key combination as defined in claim 1, wherein a body segment (113, 114) of each side tumbler in each pair is guided in a respective portion of said at least one side cavity (120), the contact fingers (115, 116) of these side tumblers in said pair projecting outwardly in parallel from said side cavity into said key slot.

3. A cylinder lock and key combination as defined in claim 2, wherein said pair of adjacent side tumbler body segments (113, 114) have supplementary cross-sections, which together substantially correspond to the cross-section of said cavity (120).

4. A cylinder lock and key combination as defined in claim 3, wherein said adjacent side tumbler body segments (113, 114) of said pair being substantially defined by half-cylindrical surface portions being guided by wall portions defining said cavity (120).

5. A cylinder lock and key combination as defined in claim 3, wherein said adjacent side tumbler body segments of said pair have mutually engaging surface portions (113*a*, 114*a*) being in sliding engagement with each other.

6. A cylinder lock and key combination as defined in claim 5, wherein said mutually engaging surface portions (113*a*, 114*a*) are substantially planar.

7. A cylinder lock and key combination as defined in claim 1, wherein said key plug (130) contains a row of side cavities (120), each such side cavity accommodating a pair of adjacent, independently movable side tumbler body portions.

8. A cylinder lock and key combination as defined in claim 1, wherein said key plug (130) includes at least one pair of locking tumblers (113, 114) in a side cavity (120) on each transversal side of said key slot (100).

9. A cylinder lock and key combination as defined in claim 1, wherein said at least two side tumblers (113, 114) cooperate with a side bar (150) being accommodated in a longitudinal recess (151) in said cylinder shell (140), said side bar (150) being adapted to normally lock the key plug against rotation in said shell and to be displaceable into a releasing position upon insertion of a properly coded key blade (200) into said key slot (100).

10. A cylinder lock and key combination as defined in claim 2, wherein said contact fingers (115,116) are positively guided in a longitudinally extending groove (202) of said key blade.

* * * * *